US008631943B2

(12) United States Patent
Kobbe et al.

(10) Patent No.: US 8,631,943 B2
(45) Date of Patent: Jan. 21, 2014

(54) PACKAGING COMPONENT

(71) Applicant: Braun GmbH, Kronberg (DE)

(72) Inventors: Manfred Bruno Kobbe, Frankfurt am Main (DE); Hauke Schormair, Griesheim (DE); Thinh Nguyen Ha, Cincinnati, OH (US); Martin Jay Marotti, Carmel, IN (US)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 13/875,352

(22) Filed: May 2, 2013

(65) Prior Publication Data

US 2013/0299364 A1 Nov. 14, 2013

Related U.S. Application Data

(60) Provisional application No. 61/644,006, filed on May 8, 2012.

(51) Int. Cl.
*A45D 44/18* (2006.01)

(52) U.S. Cl.
USPC ..... 206/747; 206/15.2; 206/467

(58) Field of Classification Search
USPC ..... 206/349, 351, 361, 362.2, 362.3, 15.2, 206/15.3, 701, 461, 467, 469, 745, 747, 206/748, 750; 220/4.26, 4.27
See application file for complete search history.

(56) References Cited

U.S. PATENT DOCUMENTS

| | | | | |
|---|---|---|---|---|
| 2,681,141 | A * | 6/1954 | Young | 206/762 |
| 3,776,375 | A | 12/1973 | Rohdin | |
| 3,990,578 | A | 11/1976 | Roeser | |
| 4,013,214 | A | 3/1977 | Hansen | |
| 4,752,029 | A | 6/1988 | Buford | |
| 4,825,624 | A | 5/1989 | Calcerano | |
| 3,536,247 | A | 10/1990 | Gadiel | |
| 4,998,616 | A * | 3/1991 | Hillinger | 206/748 |
| 5,029,705 | A | 7/1991 | Schmidt et al. | |
| 5,158,175 | A * | 10/1992 | Crawford | 206/747 |
| 5,178,282 | A | 1/1993 | Williams | |
| 5,311,996 | A * | 5/1994 | Duffy et al. | 206/453 |
| 5,405,005 | A * | 4/1995 | White | 206/363 |
| 5,447,233 | A * | 9/1995 | Smith | 206/453 |
| 5,485,919 | A | 1/1996 | Samber et al. | |

(Continued)

FOREIGN PATENT DOCUMENTS

EP 2196169 A1 6/2010

OTHER PUBLICATIONS

U.S. Appl. No. 13/875,345, filed May 2, 2013, Ha, Thinh Nguyen et al.

(Continued)

*Primary Examiner* — Jacob K Ackun
(74) *Attorney, Agent, or Firm* — John P. Colbert

(57) ABSTRACT

A package component for holding a personal care device is described. The package component has a first section and a first section cover with a first fold line therebetween. The package component also has a second section and a second section cover with a second fold line therebetween. An eccentric cover is configured to allow the first section and the first section cover to be folded with respect to the second section and the second section cover, the eccentric cover being disposed between the first section and the second section or between the first section cover and the second section cover.

11 Claims, 15 Drawing Sheets

(56) References Cited

U.S. PATENT DOCUMENTS

| | | | | |
|---|---|---|---|---|
| 5,497,894 | A | 3/1996 | Krupa et al. | |
| 5,564,569 | A | 10/1996 | Kiefer | |
| 6,059,106 | A | 5/2000 | Baker et al. | |
| 6,729,475 | B2 * | 5/2004 | Yuhas et al. | 206/746 |
| 6,923,365 | B2 | 8/2005 | Auclair et al. | |
| 7,178,311 | B2 | 2/2007 | Hoogland | |
| 7,213,709 | B2 | 5/2007 | Moskovich et al. | |
| 7,320,406 | B2 | 1/2008 | Auclair | |
| 7,427,011 | B2 | 9/2008 | Auclair et al. | |
| 7,611,042 | B2 | 11/2009 | Bates et al. | |
| 7,845,519 | B2 | 12/2010 | Newberry et al. | |
| 7,886,905 | B2 | 2/2011 | Kamada | |
| 7,922,070 | B2 | 4/2011 | Auclair | |
| 2004/0195195 | A1 | 10/2004 | Mason | |
| 2005/0051459 | A1 * | 3/2005 | Casanova | 206/703 |
| 2005/0087464 | A1 * | 4/2005 | Brattesani et al. | 206/361 |
| 2010/0230312 | A1 * | 9/2010 | Sorrentino et al. | 206/369 |
| 2011/0042375 | A1 | 2/2011 | Jones et al. | |
| 2011/0073596 | A1 | 3/2011 | Chang | |
| 2011/0100845 | A1 * | 5/2011 | Meech et al. | 206/232 |
| 2011/0147391 | A1 | 6/2011 | Corder et al. | |
| 2011/0198348 | A1 | 8/2011 | Marke et al. | |
| 2011/0210163 | A1 * | 9/2011 | Clark et al. | 229/120.05 |

OTHER PUBLICATIONS

U.S. Appl. No. 13/875,814, filed May 2, 2013, Ha, Thinh Nguyen et al.

* cited by examiner

PACKAGING COMPONENT

FIELD OF THE INVENTION

The present invention pertains to packaging of personal care appliances and more specifically to packaging of oral care appliances.

BACKGROUND OF THE INVENTION

There exist a number of toothbrushes currently available for consumer purchase. For manual toothbrushes, typically, these types of brushes are packaged in a blister package which generally includes a clear blister attached to a cardboard back card. The clear blister allows the consumer to see at least a portion of the manual toothbrush prior to purchase. Generally, these blister packages are either provided in a tray or on a hanger.

The packaging for power toothbrushes vary. For example, some power toothbrushes are provided in a clam shell package which includes a front clear blister and a back clear blister attached to one another. Within the clam shell, advertising as well as identification media may be placed. The clam shell package allows the user to see a portion of the power brush. The power brushes provided in this type of package are generally compact and with the exception of powered operation, offer little other functionality to the consumer.

In contrast to the clam shell package, some power toothbrushes are provided in a box. Typically, power brushes which offer to the consumer varied functionality are packaged in boxes. These brushes are often not very compact and because of height restrictions on store shelves, may not be able to be shown to the consumer in a state where the power handle is attached to a refill. Because the handle and the refill are not able to be coupled together, typically, the box does not include a window by which the consumer can visualize the handle and the refill. Instead, artwork on the outside of the box is utilized to provide a representation of the refill attached to the handle to the consumer.

As such, there is a need for a package, or a portion thereof, e.g. package component, which allows a power toothbrush to be perceived from multiple sides while protecting the product within the package.

SUMMARY OF THE INVENTION

A package constructed in accordance with the present invention can allow the consumer to view the powered oral care product from a variety of different vantage points. Additionally, the package component, in which the powered oral care product is placed, protects the powered oral care product from tampering.

In an embodiment, a package component for holding a personal care device comprises a first section having a front face and a back face and a first recess portion therein. A first section cover is disposed adjacent to the first section and is formed integrally with the first section. The first section cover has a front face and a back face. A first fold line is disposed between the first section and the first section cover allowing the front face of the first section cover to engage the back face of the first section. A second section has a front face and a back face and a second recess portion therein. A second section cover is disposed adjacent to the second section and is formed integrally with the second section. The second section cover has a front face and a back face. A second fold line is disposed between the second section and the second section cover allowing the front face of the second section cover to engage the back face of the second section. An eccentric cover is configured to allow the first section and the first section cover to be folded with respect to the second section and the second section cover. The eccentric cover is disposed between the first section and the second section or between the first section cover and the second section cover.

DETAILED DESCRIPTION OF THE INVENTION

A package in accordance with the present invention comprises a package component which can be translucent, at least in part, thereby allowing a consumer to visually perceive the packaged oral care product. Additionally, the package component may comprise built in secondary walls to protect the powered oral care instrument from tampering. Additionally, the packages described herein may be utilized for powered oral care products, manual oral care products, an oral care product consumable(s), e.g. dentifrice, gels, powders, rinse, floss, personal hygiene devices, personal hygiene consumables, rinses, shampoos, conditioners, lotions, the like, and/or combinations thereof. However, for convenience, the discussion below will focus on a personal hygiene device, e.g. powered oral care products.

Figure 1:
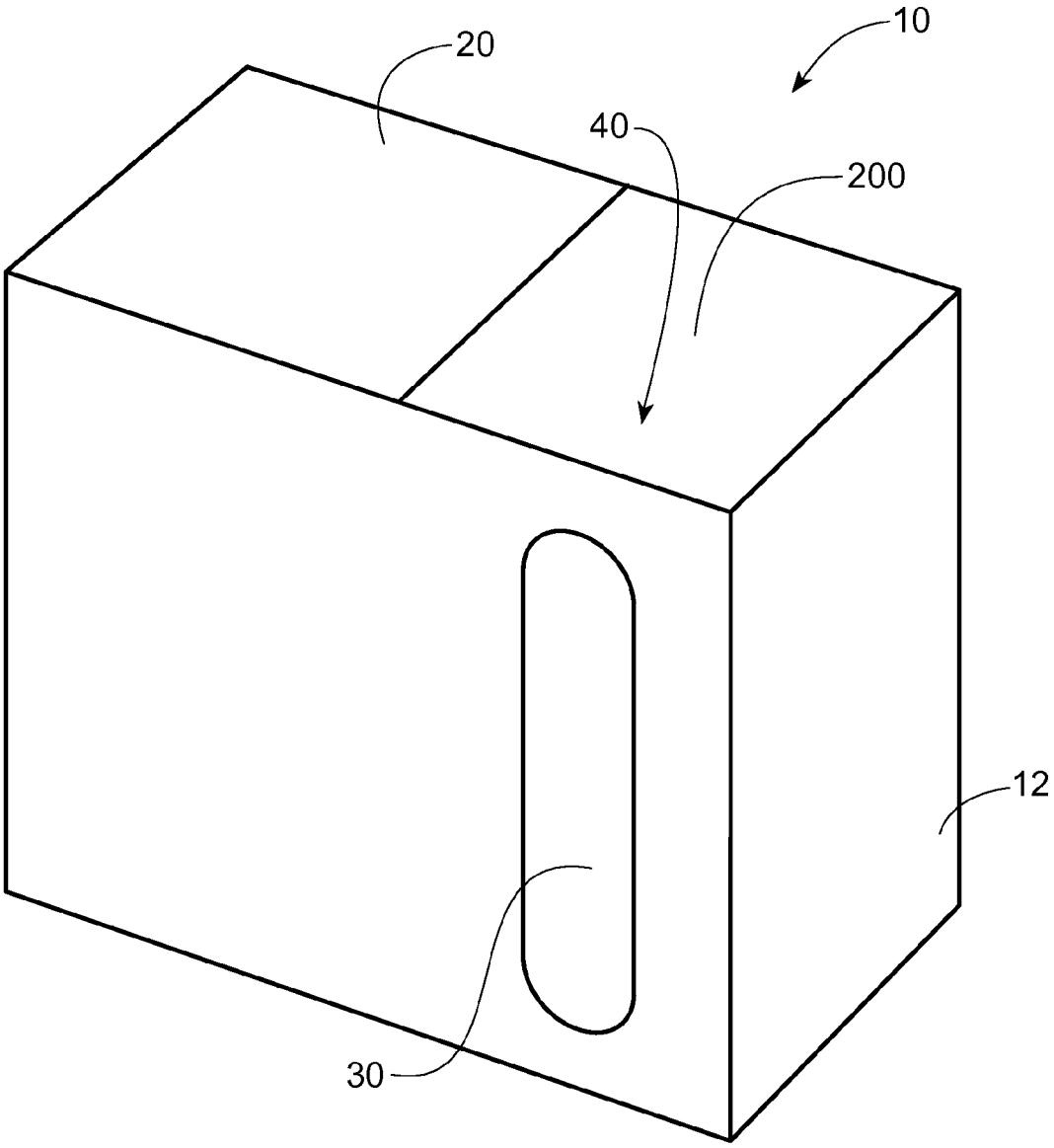
FIG. 1 is a perspective view showing a package constructed in accordance with the present invention.

As shown in FIG. 1, a package 10 for housing a personal hygiene products(s), may comprise an outer sleeve 12 having a window therein 30. The window 30 can allow a consumer to visually inspect/perceive a personal hygiene device within the package 10.

Additionally, the outer sleeve 12 may be configured such that the consumer may visually inspect/perceive the personal hygiene device from a top 40 of the package 10. The outer sleeve 12 may simiarly be configured such that the consumer may visually inspect/perceive the personal hygiene device from a bottom of the package 10 (not shown). The package 10 may comprise a package component 200 and a container 20. The container 20 may be any suitable size and may be configured to house a variety of oral care products. In some embodiments, a plurality of containers may be provided within the outer sleeve 12. For example, in some embodiments, the containter 20 may comprise at least one container within the container 20. As another example, a plurality of containers may be utilized in place of container 20.

The package component 200 may comprise a transparent material adjacent the window 30, the top 40, and/or the bottom (not shown) to allow the consumer to visually inspect/ perceive the personal hygiene device. In some embodiments, the outer sleeve 12 may comprise a window opposite the window 30 which can provide another view of the personal hygiene device to the consumer. In such embodiments, the package component 200 may comprise a transparent material adjacent this window in addition to the areas mentioned heretofore.

Figure 2:
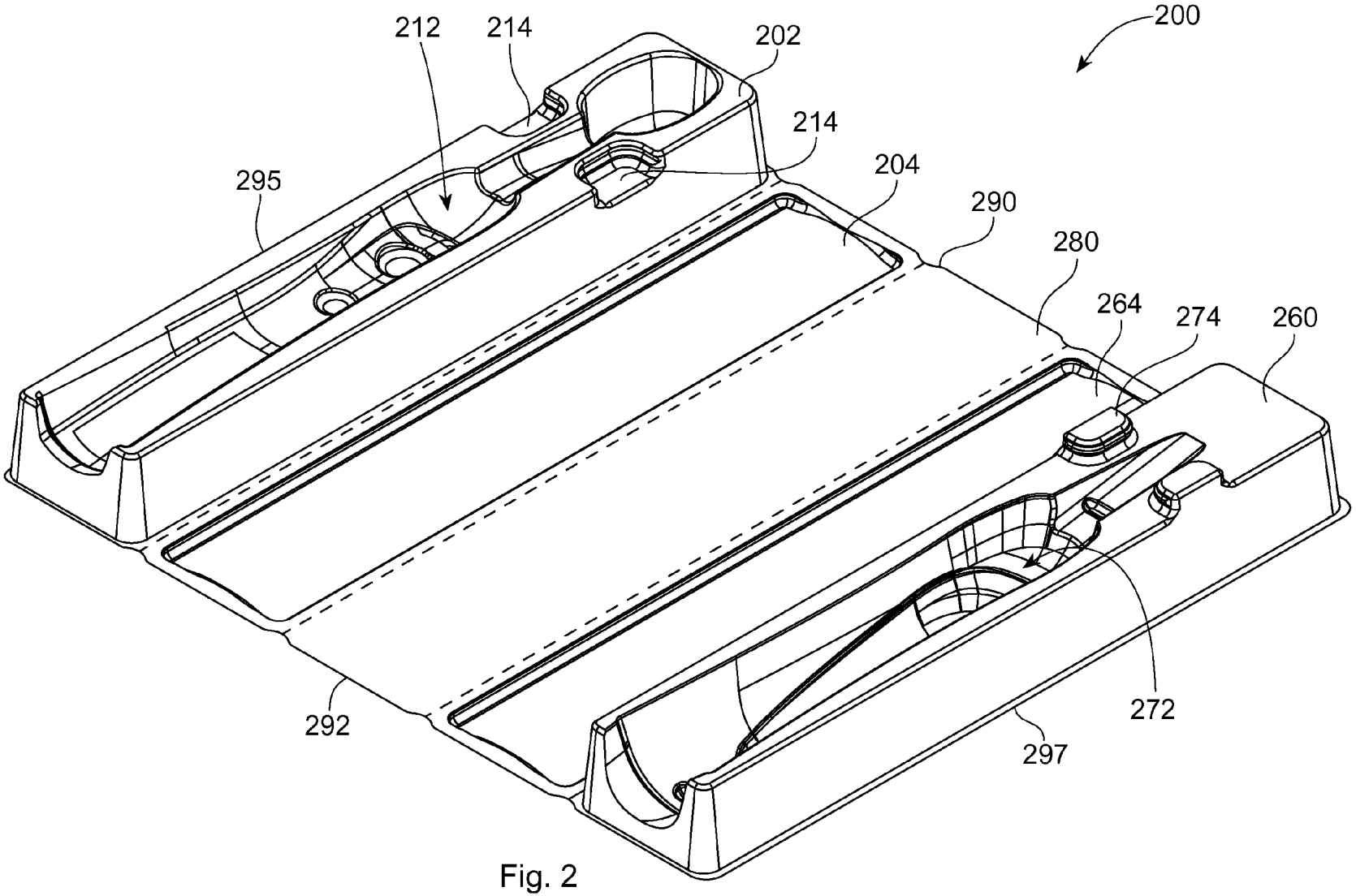
FIG. 2 is a perspective view showing an embodiment of a package component in an unfolded state.

For ease of packaging, the package comonent 200 may comprise a plurality of sections which may be folded with respect to one another. As shown in FIG. 2, the package component 200 may comprise a first section 202 having a recess 212 therein for receiving a portion of the personal hygiene device. Adjacent the first section 202, a first section cover 204 may be positioned. Opposite the first section 202, the package component 200 may comprise a second section 260 having a recess 272 therein for receiving a portion of the personal hygiene device. Adjacent the second section 260, a second section cover 264 may be positioned. Between the first section cover 204 and the second section cover 264, an eccentric cover 280 may be positioned.

As shown, the first section 202, the first section cover 204, the eccentric cover 280, the second section cover 264, and/or the second section 260 may be unitary with one another. However, embodiments are contemplated where the first section 202, the first section cover 204, the eccentric cover 280, the second section cover 264, and/or the second section 260 are discrete from one another. For example, the first section 202 and the first section cover 204 may be integrally formed, and the second section 260 and the second section cover 264 may be integrally formed. In such embodiments, the eccentric cover 280 may be discrete and attached to the first section 202, the second section 260, the first section cover 204, and/or the second section cover 264. Additionally, embodiments are contemplated where the package component 200 does not include the eccentric cover 280.

Still referring to FIG. 2, the first section 202 may comprise receiving areas 214 while the second section 260 includes engagement areas 274. When assembled, the engagment areas 274 engage the receiving areas 214. The interaction between the engagement areas 274 and the receiving areas 214 can help align the first section 202 and the second section 260. Additionally, the interaction between the engagement areas 274 and the receiving areas 214 can provide some resistance to the separation of the first section 202 from the second section 260 thereby reducing the likelihood that the first section 202 and the second section 260 will separate accidentally. Embodiments are contemplated where the first section 202 and/or the second section 260 comprise at least one engagement area 274 and/or at least one receiving area 214.

The engagement areas 274 and/or receiving areas 214 may be positioned in any suitable location. For example, engagement areas 274 and/or receiving areas 214 may be positioned adjacent a first edge 290 and/or adjacent a second edge 292 of the package component 200. As another example, the engagement areas 274 and/or receiving areas 214 may be positioned adjacent lateral edges 295 and 297. As yet another example, the engagement areas 274 and/or receiving areas 214 may be positioned adjacent the first edge 290, the second edge 292, and/or adjacent lateral edges 295 and 297.

Figure 3A:
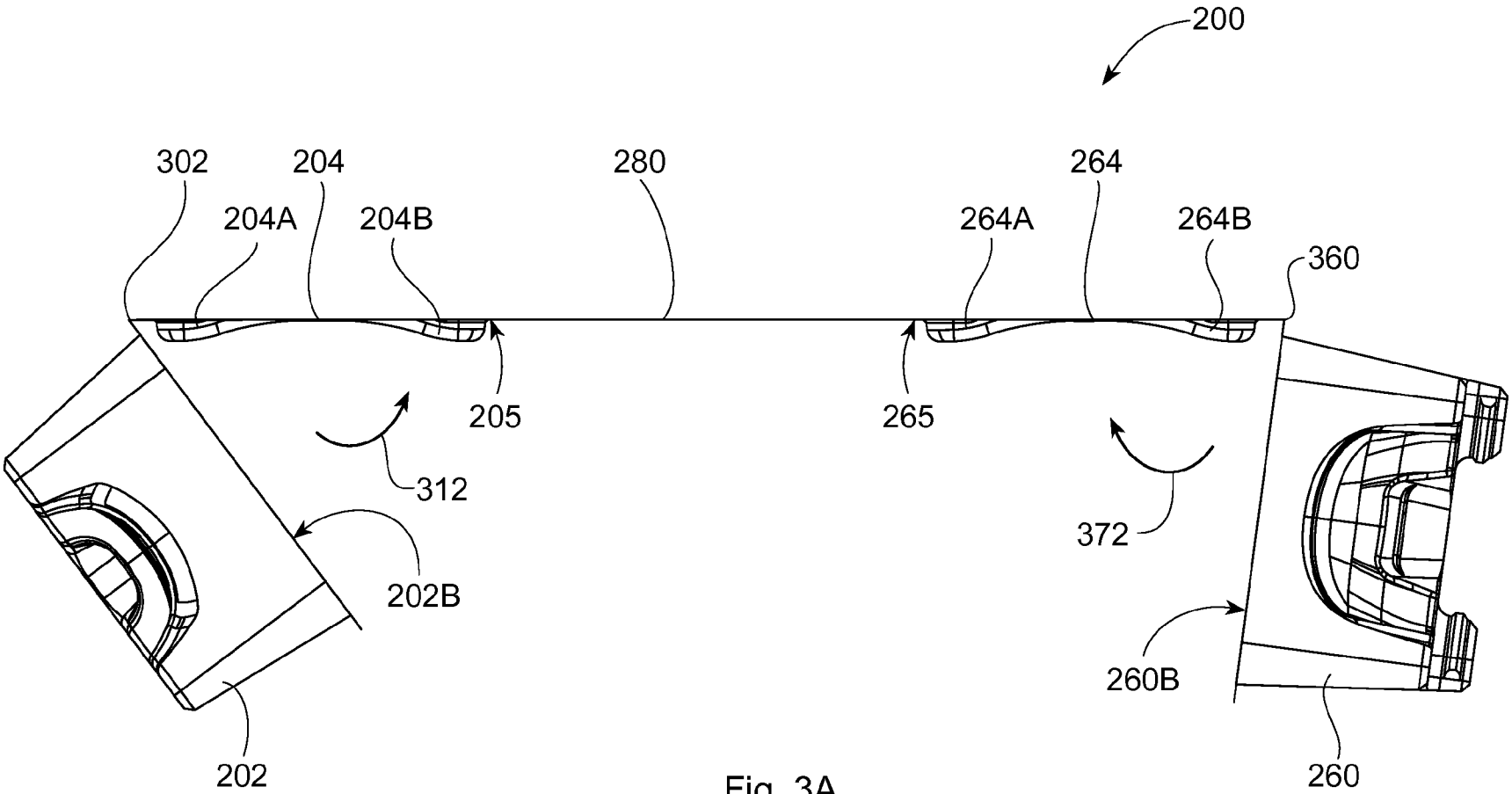
FIG. 3A-3D are end views showing the package component of FIG. 2 after various folding maneuvers.

As stated previously the first section 202 may be folded with respect to the first section cover 204 which may be folded with respect to the eccentric cover 280. And, the second section 260 may be folded with respect to the second section cover 264 which may be folded with respect to the eccentric cover 280. Referring to FIG. 3A, the first section 202 may be folded along a first folding line 302 which extends between the first section 202 and the first section cover 204. The first section 202 may be folded in a first counter-clockwise direction as shown by arrow 312 about the first folding line 302. When the fold of the first section 202 is completed, a front face 205 of the first section cover 204 engages a back surface 202B of the first section 202.

The first section cover 204 may comprise at least one detent, e.g. 204A, 204B, which can engage an interior surface of the first section 202 and extend from the front face 205. These detents can be configured to provide some resistance to the separation of the first section 202 and the first section cover 204 once the first section 202 and the first section cover 204 are engaged with one another. Additional benefits of the detents 204A, 204B are discussed hereafter.

Referring to FIGS. 2 and 3A, the detents 204A, 204B may extend any suitable length. In some embodiments, the detents 204A, 204B may extend from the first edge 290 to the second edge 292. In other embodiments, the detents 204A, 204B, may not extend from the first edge 290 to the second edge 292. In such embodiments, the detents 204A, 204B may be positioned in any suitable location, e.g. adjacent the first edge 290, adjacent the second edge 292, or equidistant between the first edge 290 and the second edge 292. Yet in further embodiments, a plurality of discrete detents may be utilized. For example, in some embodiments three or more detents may be utilized.

As shown in FIG. 3A and similar to the first section 202, the second section 260 may be folded along a second folding line 360 which extends between the second section 260 and the second section cover 264. The second section 260 may be folded in a first clockwise direction as shown by arrow 372 about the second folding line 360. When the fold of the second section 260 is completed, a front face 265 of the second section cover 264 engages a back surface 260B of the second section 260.

The second section cover 264 may comprise at least one detent, e.g. 264A, 264B, which can engage an interior surface of the second section 260 and extend from the front face 265. These detents 264A and 265B can be configured as discussed heretofore with regard to the detents of the first section cover 204.

Figure 3B:
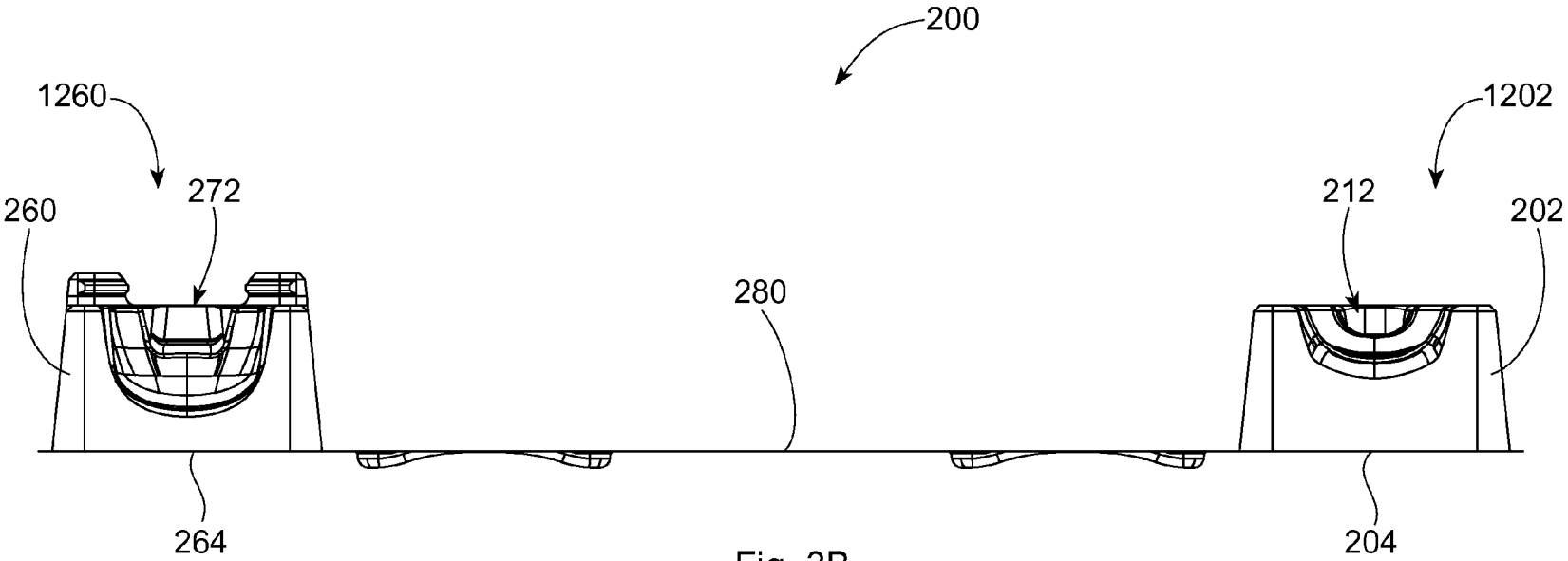

Regarding FIG. 3B, the first section 202 and the second section 260 are shown after being folded such that each engages its respective cover. Once the first section 202 and the second section 260 are folded and engaged with their respect to their respective covers, a first portion 1202 and a second portion 1260 are created. At this point, an individual on an assembly line may place the personal hygiene device within a recess, e.g. 212, 272 in the first portion 1202 or the second portion 1260. Alternatively, a machine could be utilize to place the personal hygiene device within one of the recesses.

Figure 3C:
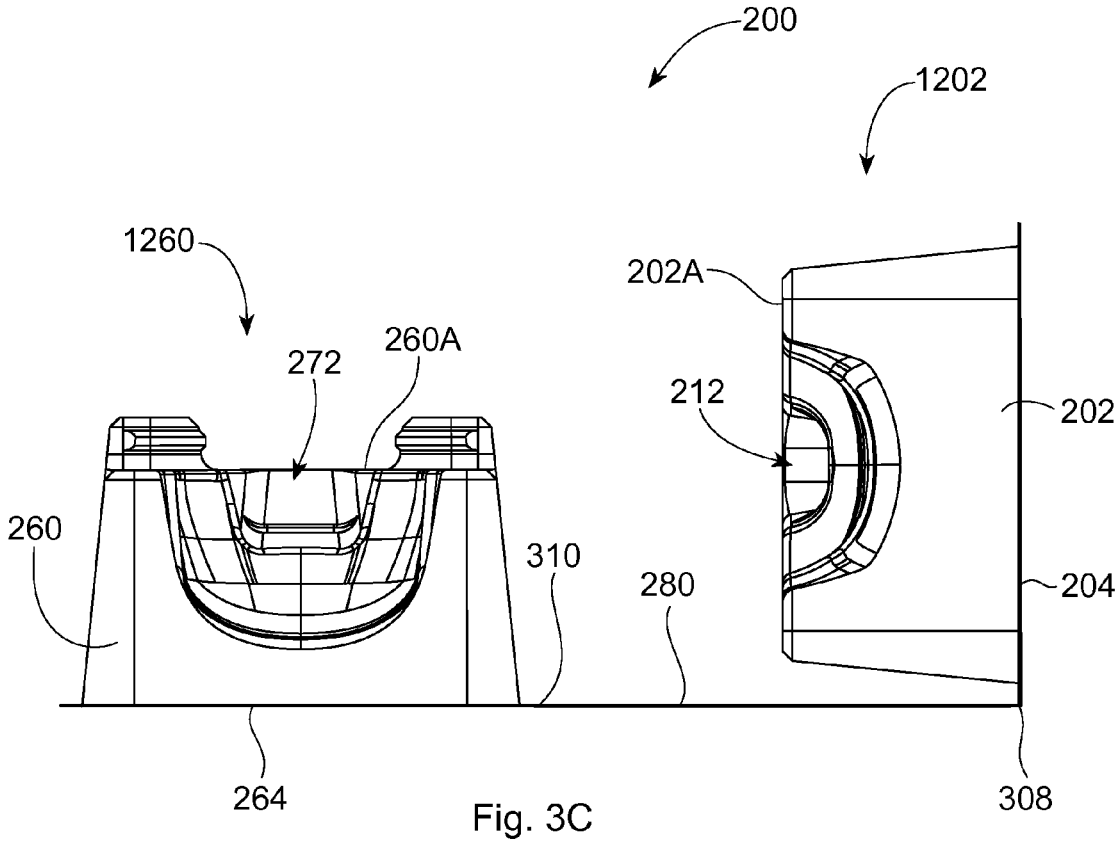

Referring to FIG. 3C, if the personal hygiene device is placed in the recess 272 in the second section 260, then the first portion 1202 (including the first section 202 and the first section cover 204) may be folded along a third folding line 308. In contrast, if the personal hygiene device is placed in the recess 212, then the second portion 1260 (including the second section 260 and the second section cover 264) may be folded along a fourth folding line 310.

Figure 3D:
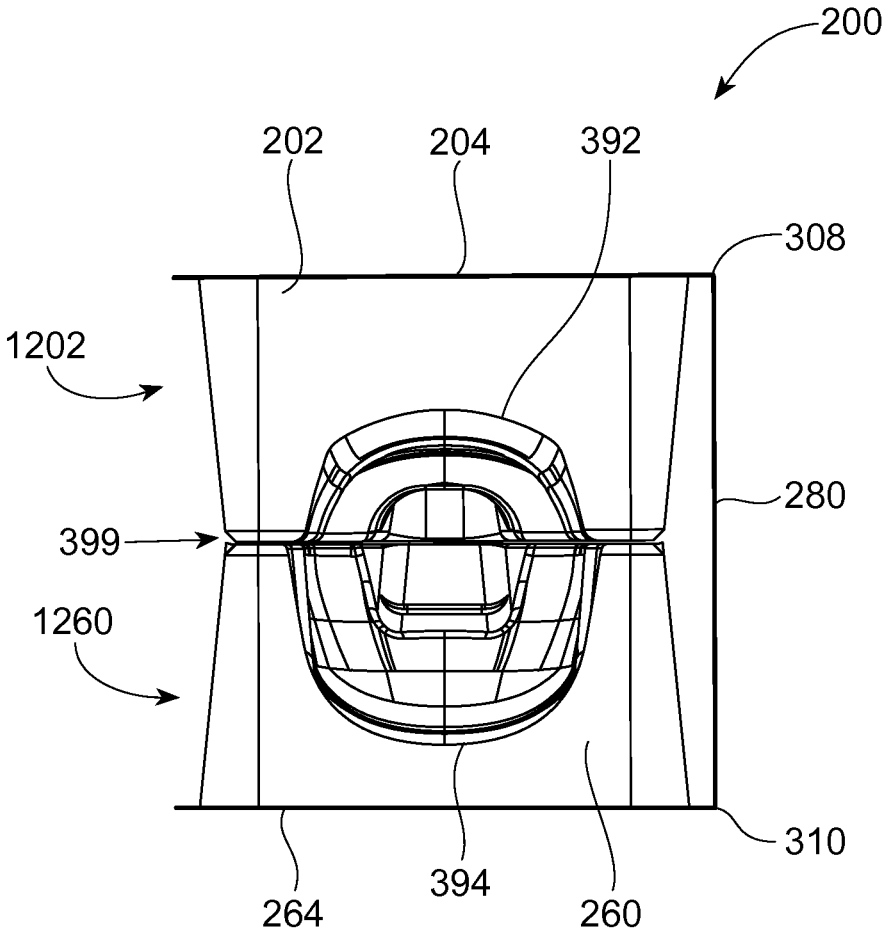

In order to completely enclose the personal hygiene device within the package component 200, the first portion 1202 (including the first section 202 and the first section cover 204) and the eccentric cover 280 may be folded about the fourth folding line 310 such that a front face 202A of the first section 202 is positioned adjacent a front face 260A of the second section 260, as shown in FIG. 3D. In contrast, the second portion 1260 (including the second section 260 and the second section cover 264) and the eccentric cover 280 may be foled abou the third folding line 308 such that the front face 202A of the first section 202 is positioned adjacen the front face 260A of the second section 260.

In the assembled state, the package component 200 protects the personal hygiene product with two layers/levels. First, the recess(es) in which the personal hygiene device is disposed is formed via a first outer shell 392 and a second outer shell 394. The first outer shell 392 and the second outer shell 394 may substantially surround the personal hygiene device such that the liklihood of contaminants coming into contact with the personal hygiene device is reduced. Second, the first section cover 204 provides protection to the first outer shell 392 while the second section cover 264 provides protection to the second outer shell 394. The first section cover 204 and the second section cover 264 can provide protection for the first outer shell 392 and the second outer shell 394, respectively, to reduce the likelihood of tampering with the first outer shell 392 and/or the second outer shell 394.

Referring to FIGS. 1 and 3D, in the on store shelf package 10, the package component 200 may be positioned such that the first section cover 202 or the second section cover 264 are positioned adjacent the window 30. The positioning of the first section cover 202 or the second section cover 264 adjacent the window can allow the consumer to visually perceive the personal hygiene device or a component thereof. For those embodiments, where the package 10 comprises a first window, e.g. 30, and a second window opposite the first window, the first section cover 204 and the second section cover 264 may be positioned adjacent the first window and the second window respectively. This can allow the consumer to view the personal hygiene device or component thereof from multiples sides, e.g. front and back. Embodiments are contemplated where the eccentric cover 280 is positioned adjacent the window 30. This orientation may allow the consumer to view a left or right side of the personal hygiene device. In such embodiments, a window opposite the window 30 may be utilized; however, a seam 399 may be exposed in the opposite window.

As discussed previously, the first section cover 204 and the second section cover 264 may comprise detents which facilitate the couping to the first section 202 and the second section 260 respectively. Additionally, the creation of the detents on the first section cover 204 and the second section cover 264 can provide structural support for the first section cover 204 and the second section cover 264.

Figure 4:
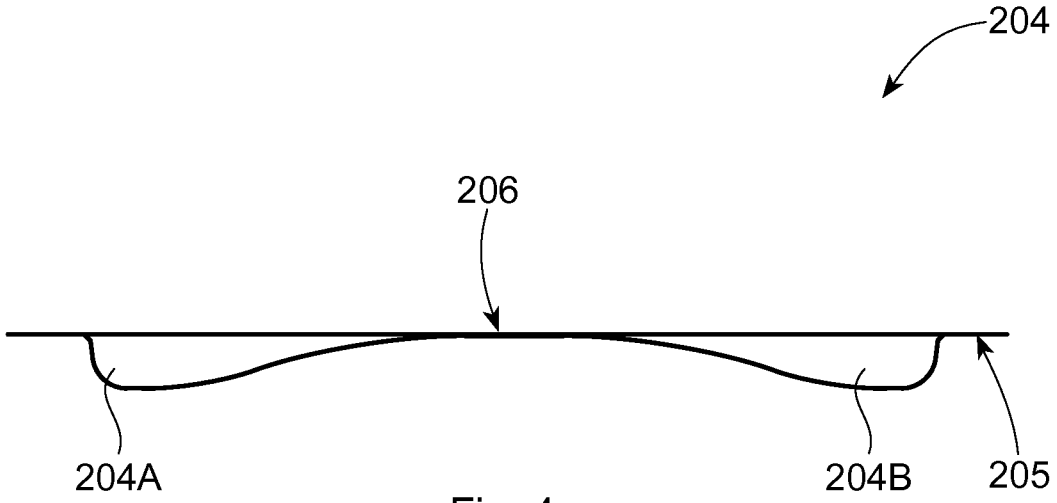
FIG. 4 is an end view showing a portion of the package component of FIG. 2.

Referring to FIG. 4, the presence of detents, e.g. 204A, 204B, can provide curvature to the front section cover 204. As discussed previously, the front face 205 of the first section cover 204 faces the first outer shell 392 (shown in FIG. 3D) in the completely folded state. A back face 206, opposite the front face 205, may be positioned in the window 30 (shown in FIG. 1). Because the curvature of the first section cover 204 is convex when viewing from the back face 206, there is some structural support provided to the back face 206. The second section cover 264 may be similarly configured.

Embodiments are contemplated where the package component 200 may be utilized as a traveling case for a personal hygiene device. In such embodiments, the package component 200 may comprise a releasable snap feature. As an example, the package component 200 may comprise velcro, magnetic closures, resealable tape, the like, and/or any suitable fastening mechanism. The releasable snap feature or other mechanism may be employed at or near an interface between the first section and the second section.

Figure 5:
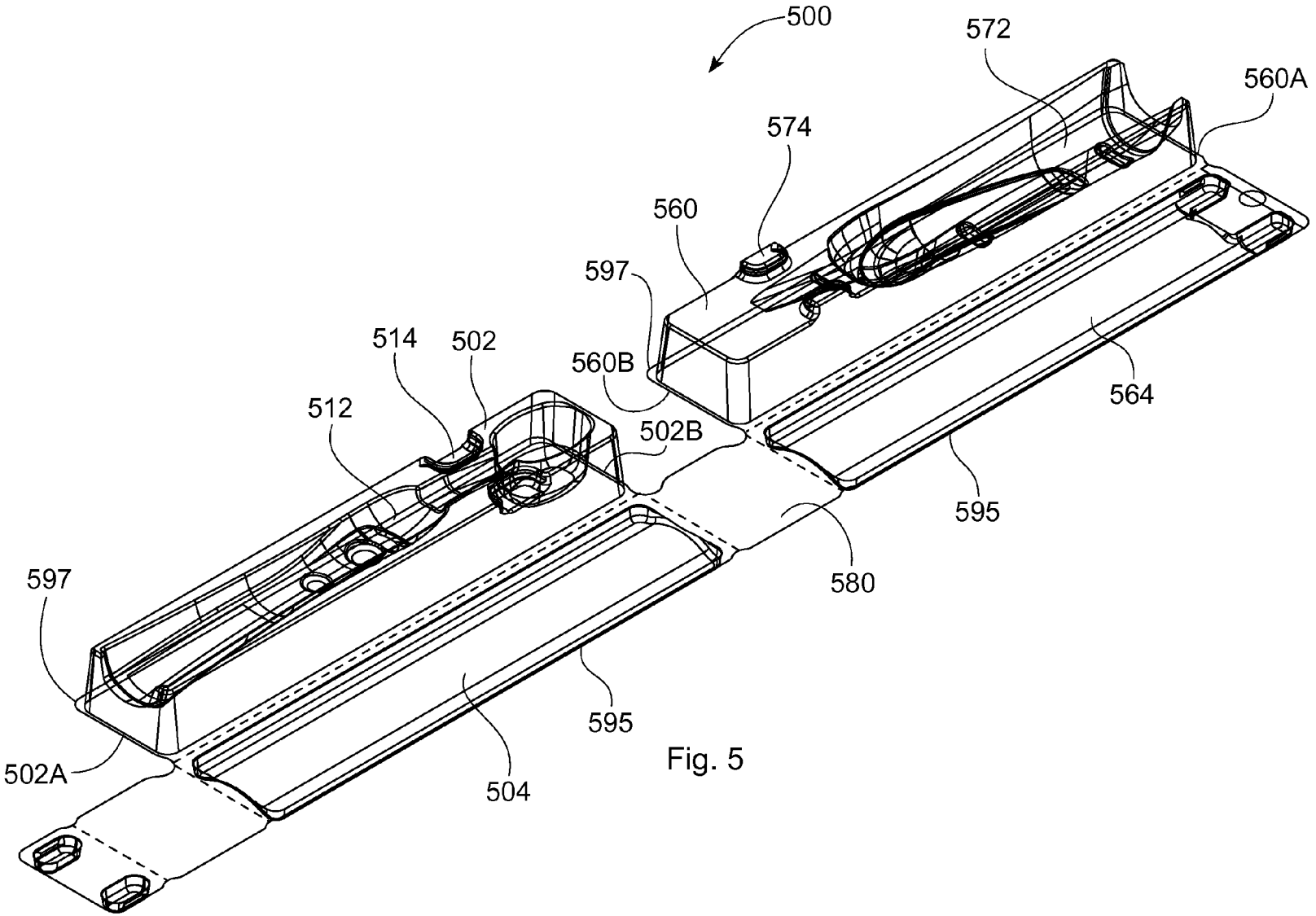
FIG. 5 is a perspective view showing another embodiment of a package component in an unfolded state.

Referring to FIGS. 1 and 5, another package component 500 for carrying a personal hygiene device may be utilized in the package 10. The package component 500 may comprise a transparent material adjacent the window 30, the top 40, and the bottom (not shown) to allow the consumer to visually inspect/perceive the personal hygiene device. In some embodiments, the outer sleeve 12 may comprise a window opposite the window 30 which can provide another view of the personal hygiene device to the consumer. In such embodiments, the package component 500 may comprise a transparent material adjacent this window in addition to the areas mentioned heretofore.

For ease of packaging, the package component 500 may comprise a plurality of sections which may be folded with respect to one another. As shown in FIG. 5, the package component 500 may comprise a first section 502 having a recess 512 therein for receiving a portion of the personal hygiene device. Adjacent the first section 502, a first section cover 504 may be positioned.

The package component 500 may comprise a second section 560 having a recess 572 therein for receiving a portion of the personal hygiene device. Adjacent the second section 560, a second section cover 564 may be positioned. Between the first section cover 504 and the second section cover 564, an eccentric cover 580 may be positioned.

As shown, the first section 502, the first section cover 504, the eccentric cover 580, the second section cover 564, and the second section 560 may be unitary with one another. However, embodiments are contemplated where the first section 502, the first section cover 504, the eccentric cover 580, the second section cover 564, and/or the second section 560 are discrete from one another. For example, the first section 502 and the first section cover 504 may be integrally formed, and the second section 560 and the second section cover 564 may be integrally formed. In such embodiments the eccentric cover 580 may be discrete and attached to the first section 502, the second section 560, the first section cover 504, and/or the second section cover 564. Additionally, embodiments are contemplated where the package component 500 does not include the eccentric cover 580.

The first section 502 may comprise receiving areas 514 while the second section 560 includes engagement areas 574. When assembled, the engagment areas 574 engage the receiving areas 514. The interaction between the engagement areas 574 and the receiving areas 514 can help align the first section 502 and the second section 560. Additionally, the interaction between the engagement areas 574 and the receiving areas 514 can provide some resistance to the separation of the first section 502 from the second section 560 thereby reducing the likelihood that the first section 502 and the second section 560 will separate inadvertently. Embodiments are contemplated where the first section 502 and/or the second section 560 comprise at least one engagement area 574 and/or at least one receiving area 514.

The engagement areas 574 and/or receiving areas 514 may be positioned in any suitable location. For example, engagement areas 574 and/or receiving areas 514 may be positioned adjacent a first edge 502A, 560A and/or adjacent a second edge 502B, 560B of the package component 500. As another example, the engagement areas 574 and/or receiving areas 514 may be positioned adjacent lateral edges 595 and 597. As yet another example, the engagement areas 574 and/or receiving areas 514 may be positioned adjacent the first edge 502A, 560A, the second edge 502B, 560B, and/or adjacent lateral edges 595 and 597.

Figure 6A:
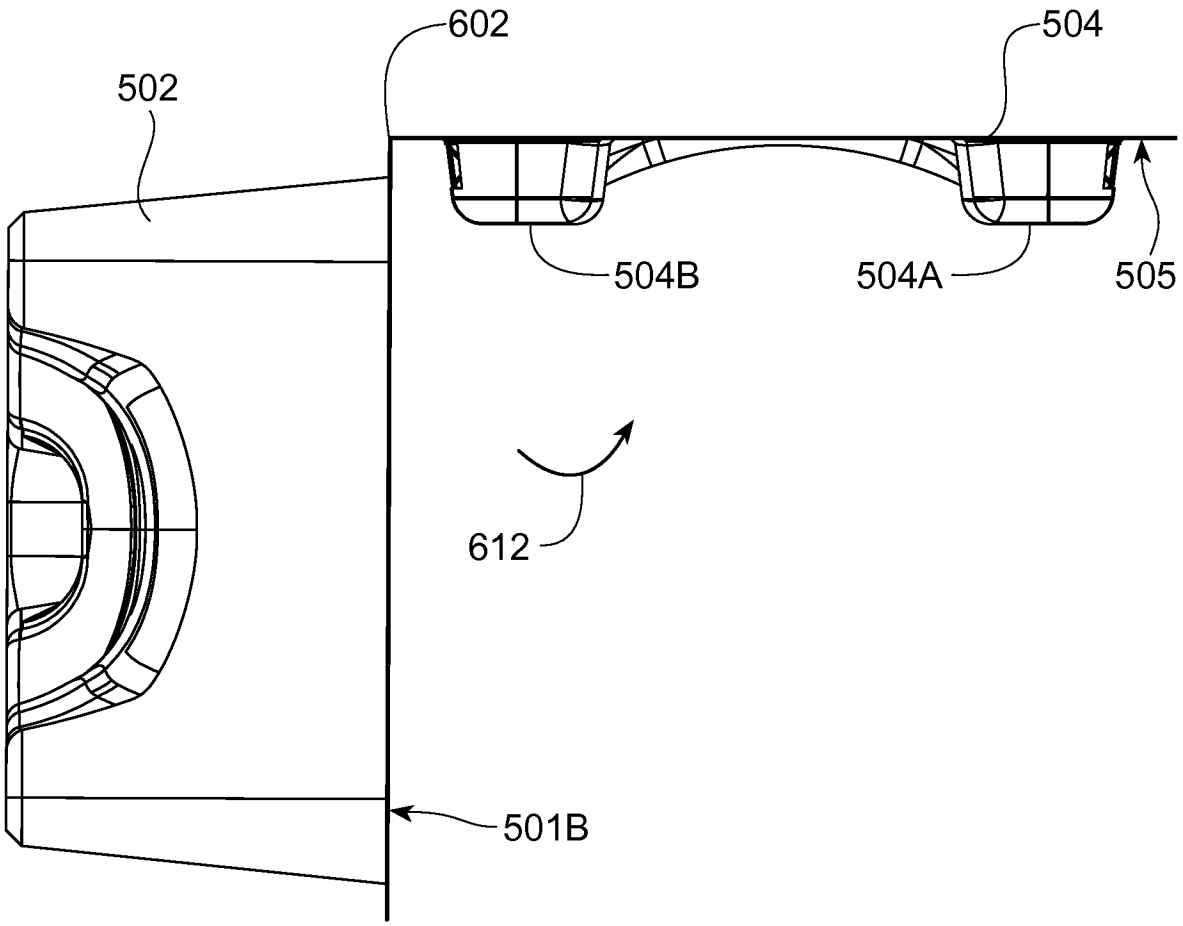
FIGS. 6A-6C are varied views of the package component of FIG. 5 after various folding maneuvers.

As stated previously the first section 502 may be folded with respect to the first section cover 504 which may be folded with respect to the eccentric cover 580. And, the second section 560 may be folded with respect to the second section cover 564 which may be folded with respect to the eccentric cover 580. Referring to FIG. 6A, an elevation view of the package component is shown viewing the first section 502 from the first edge 502A toward the second edge 502B. The first section 502 may be folded along a first folding line 602 which extends between the first section 502 and the first section cover 504. The first section 502 may be folded in a first counter-clockwise direction as shown by arrow 612 about the first folding line 602. When the fold of the first section 502 is completed, a front face 505 of the first section cover 504 engages a back surface 501B of the first section 502.

The first section cover 504 may comprise at least one detent, e.g. 504A, 504B, which can engage an interior surface of the first section 502 and extend from the front face 505. These detents can be configured to provide some resistance to the separation of the first section 502 and the first section cover 504 once the first section 502 and the first section cover 504 are engaged with one another. Additional benefits of the detents 504A, 504B are discussed hereafter.

Referring to FIGS. 5 and 6A, the detents 504A, 504B may extend any suitable length. In some embodiments, the detents 504A, 504B may extend from the first edge 502A to the second edge 502B. In other embodiments, the detents 504A, 504B, may not extend from the first edge 502A to the second edge 502B. In such embodiments, the detents 504A, 504B may be positioned in any suitable location, e.g. adjacent the first edge 502A, adjacent the second edge 502B, or equidistant between the first edge 502A and the second edge 502B. Yet in further embodiments, a plurality of discrete detents may be utilized. For example, in some embodiments three or more detents may be utilized.

Figure 6B:
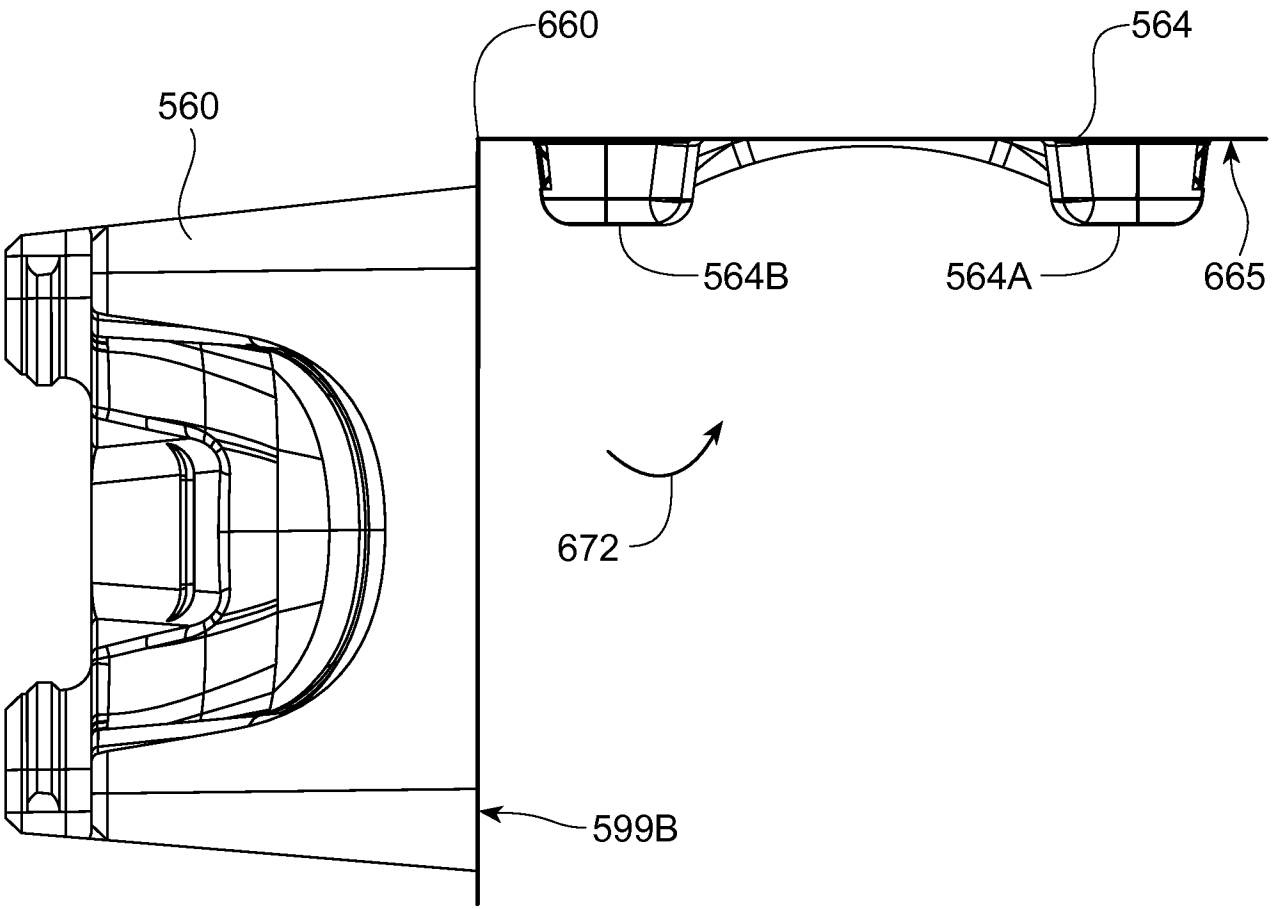

As shown in FIG. 6B, an elevation view of the package component 500 is shown viewing the second section 560 from the first edge 560A toward the second edge 560B. Similar to the first section 502, the second section 560 may be folded along a second folding line 660 which extends between the second section 560 and the second section cover 564. The second section 560 may be folded in a second counter-clockwise direction as shown by arrow 672 about the second folding line 660. When the fold of the second section 560 is completed, a front face 665 of the second section cover 664 engages a back surface 599B of the second section 560.

The second section cover 564 may comprise at least one detent, e.g. 564A, 564B, which can engage an interior surface of the second section 560 and extend from the front face 665. These detents 564A and 565B can be configured as discussed heretofore with regard to the detents of the first section cover 504, 204.

Figure 6C:
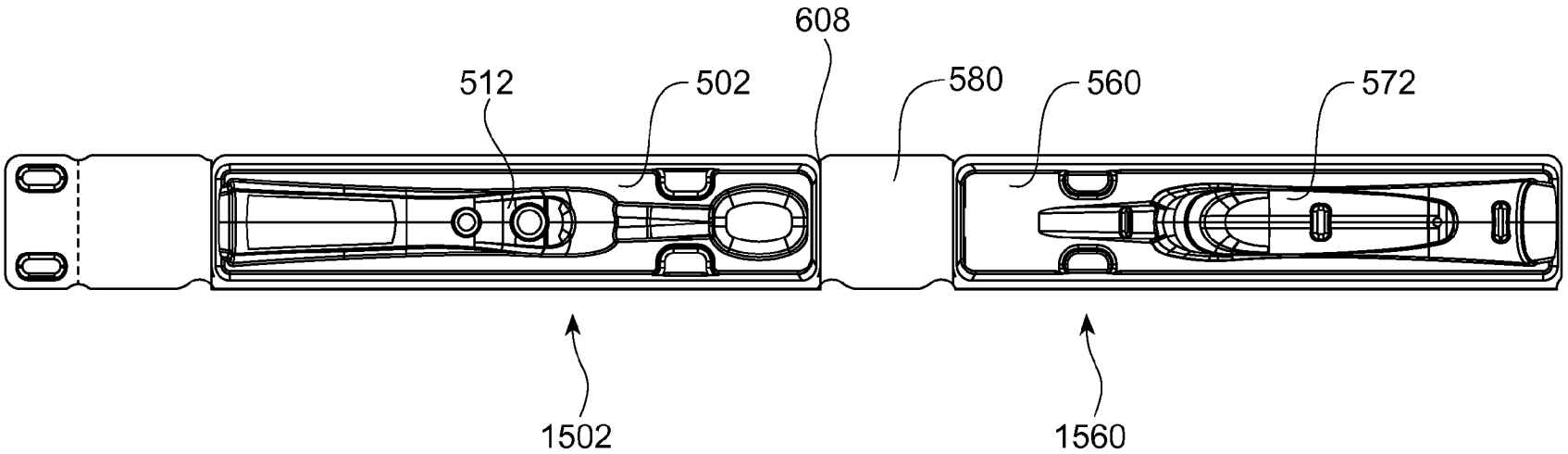

Regarding FIG. 6C, the first section 502 and the second section 560 are shown after being folded such that each engages its respective cover. Once the first section 502 and the second section 560 are folded and engaged with their respective covers, a first portion 1502 and a second portion 1560 are created. At this point, an individual on an assembly line may place the personal hygiene device within a recess, e.g. 512, 572 in the first portion 1502 or the second portion 1560. Alternatively, a machine could be utilize to place the personal hygiene device within one of the recesses.

Figure 7A:
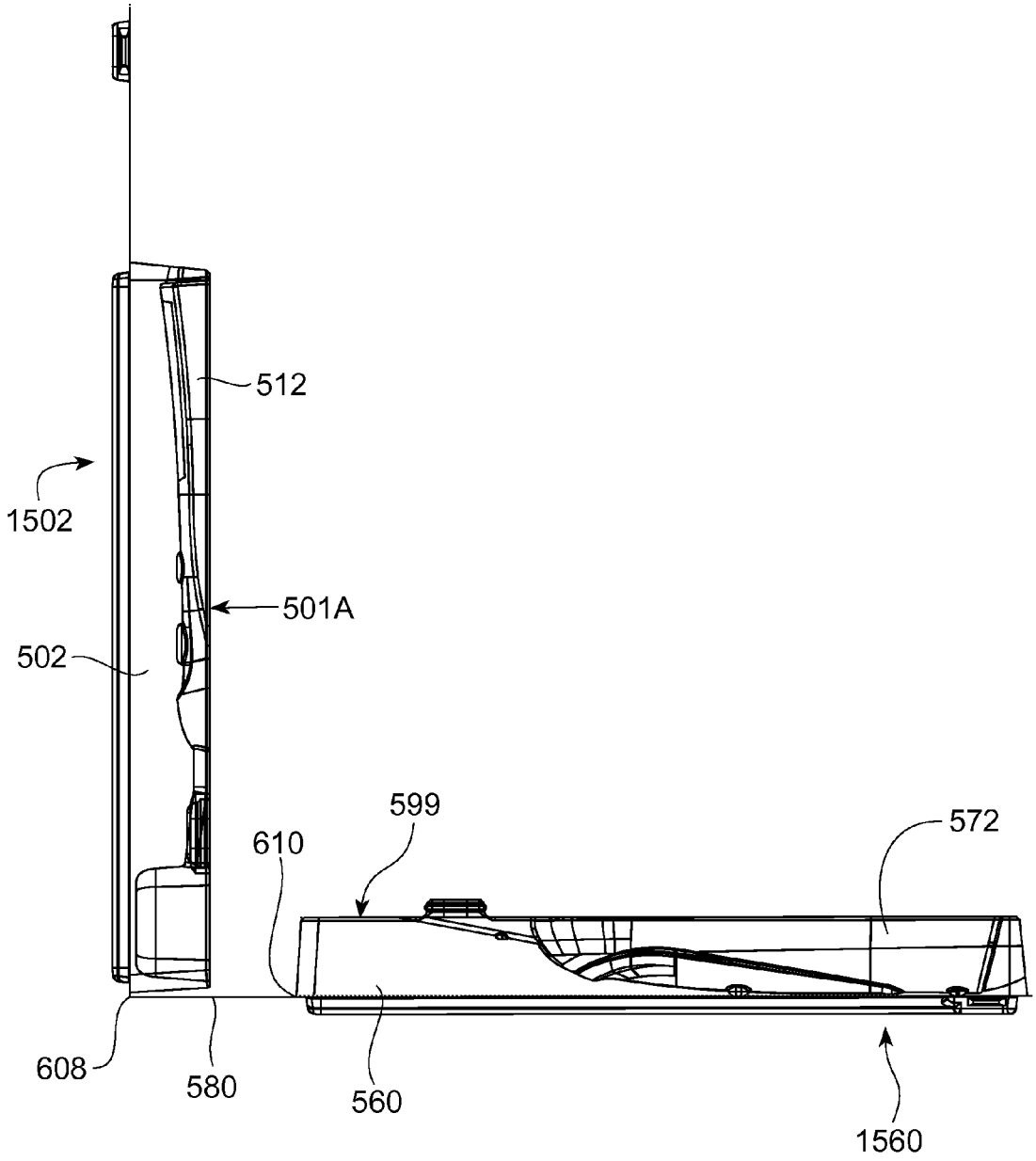
FIGS. 7A and 7B are side views showing the side of the package component of FIG. 5 after various folding maneuvers.
Figure 7B:
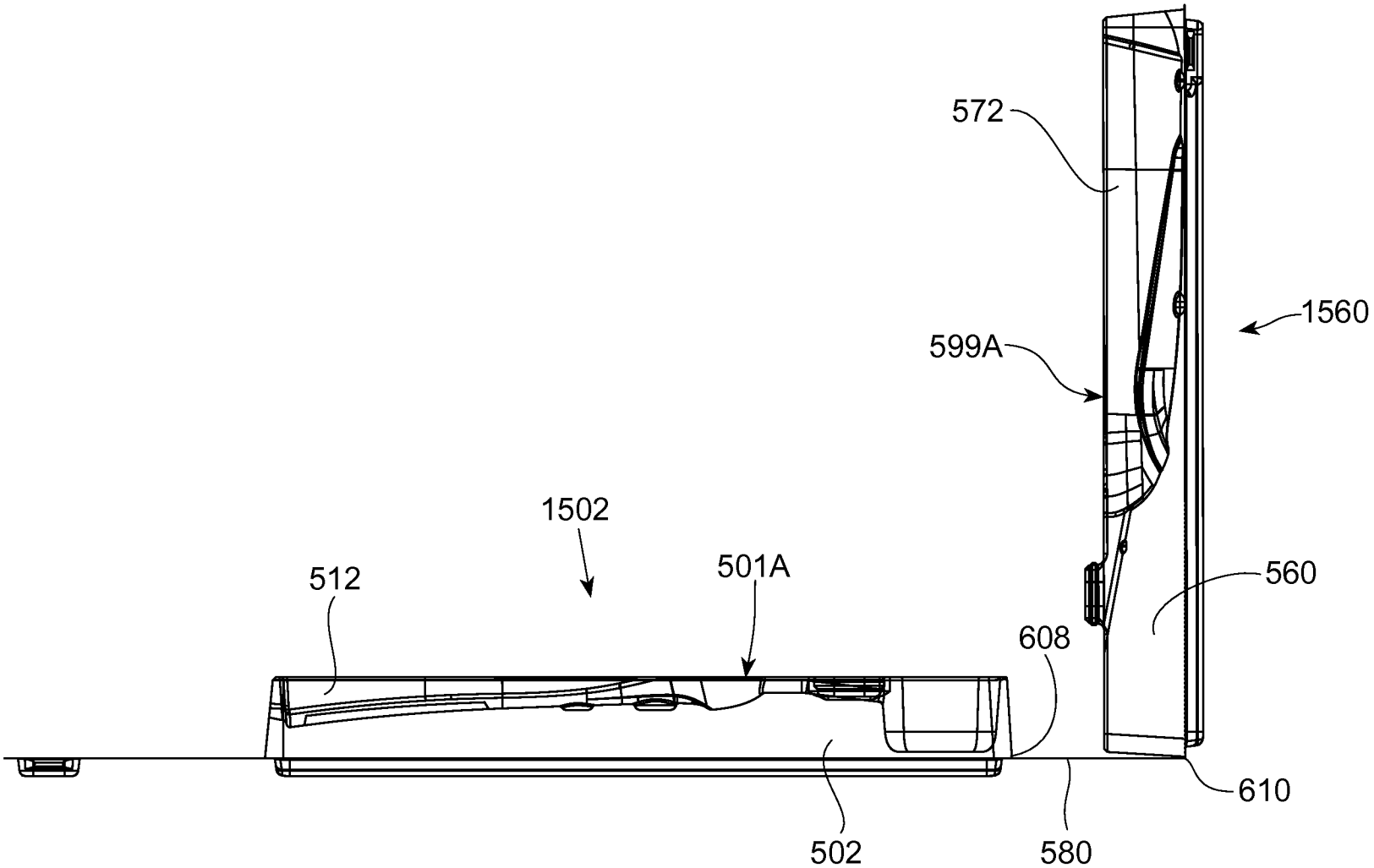

Referring to FIGS. 6C, 7A, and 7B, if the personal hygiene device is placed in the recess 572 in the second section 560, then the first portion 1502 (including the first section 502 and the first section cover 504) may be folded along a third folding line 608. In contrast, if the personal hygiene device is placed in the recess 512, then the second portion 1260 (including the second section 560 and the second section cover 564) may be folded along a fourth folding line 610.

In order to completely enclose the personal hygiene device within the package component 500, the first portion 1502 (including the first section 502 and the first section cover 504) and the eccentric cover 580 may be folded about the fourth folding line 610 such that a front face 501A of the first section 502 is positioned adjacent a front face 599A of the second section 560. In contrast, the second portion 1560 (including the second section 560 and the second section cover 564) and the eccentric cover 580 may be foled abou the third folding line 608 such that the front face 501A of the first section 502 is positioned adjacen the front face 599A of the second section 560.

Figure 8:
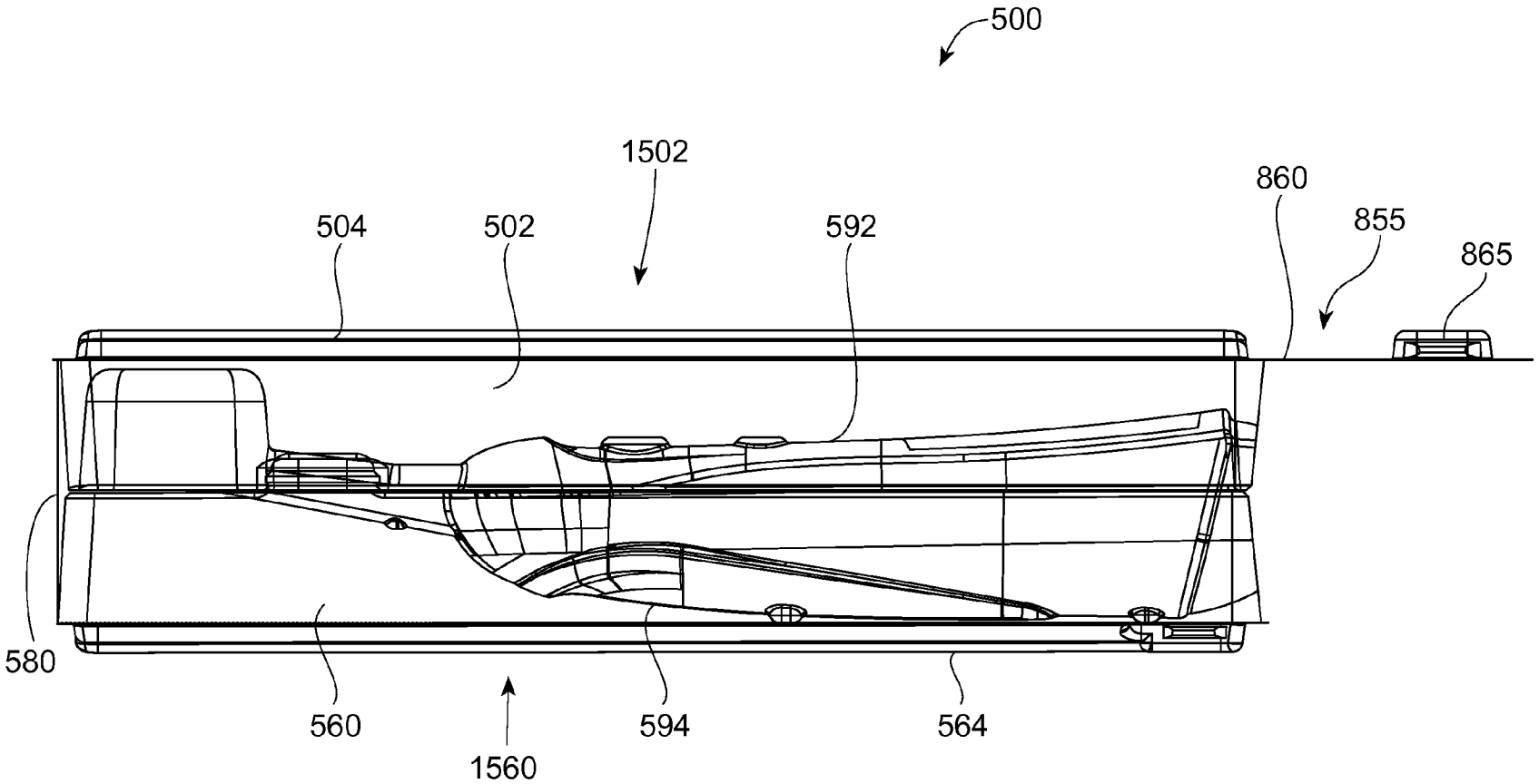
FIG. 8 is a side view showing the packaging component of FIG. 5 in an assembled state.

When the first portion 1502 and the second portion 1560 are engaged, a locking mechanism 855 may engage the second portion 1560 as shown in FIG. 8. The locking mechanism 855 may comprise an extension portion 860 and a receiving portion 865 which can engage a corresponding engagment portion on the second portion 1560. In some embodiments, the receiving portion 865 may comprise detents and the engagement portion may comprise corresponding recesses for receiving the detents or vice versa or combinations thereof.

As shown, the locking mechanism 855 may extend from the first section cover 504 (shown in FIG. 5). Alternatively, the locking mechanism 855 may extend from the first section 502. The locking mechanism 855 may be discrete and attached to the first section 502 and/or the first section cover 504. Alternatively, the locking mechanism 855 may be integrally formed with the first section 502 and/or the first section cover 504.

In other embodiments, the locking mechanism 855 may extend from the second portion 560 and/or the second portion cover 564 (shown in FIG. 5). In such embodiments, the locking mechanism 855 may engage the first portion 1502 as described heretofore with regard to the engagement between the locking mechanism and the second portion 1560.

Figure 9:
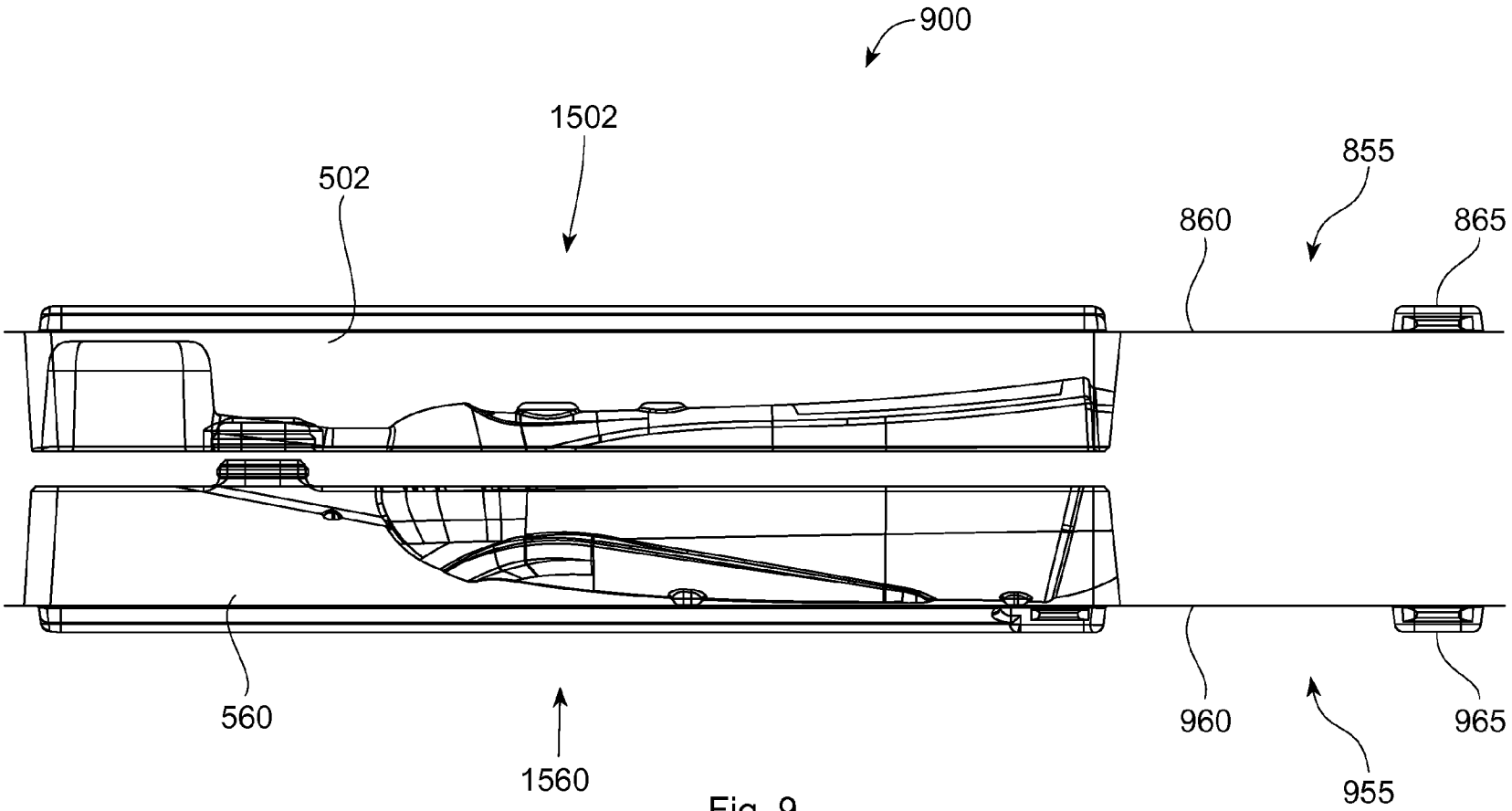
FIG. 9 is a side view showing another embodiment of a packaging component in an assembled state.

Still in other embodiments, referring to FIG. 9, for a packag component 900, the first portion 1502 and/or the second portion 1560 may comprise the locking mechanism 855 as described above. The other of the first portion 1502 and/or the second portion 1560 may comprise a receiving element 955 which is meant to engage the locking mechanism 855. The receiving element 955 may comprise an extension portion 960 and a receiving portion 965. Embodiments are contemplated where the package component 200 comprises a locking mechanism 865 and/or a receiving element 955 as described heretofore.

Referring to FIGS. 8 and 9, in the assembled state, the package component 500, 900 protects the personal hygiene product with two layers/levels. First, the recess(es) in which the personal hygiene device is disposed is formed via a first outer shell 592 and a second outer shell 594. The first outer shell 592 and the second outer shell 594 may substantially surround the personal hygiene device such that the liklihood of contaminants coming into contact with the personal hygiene device is reduced. Second, the first section cover 504 provides protection to the first outer shell 592 while the second section cover 564 provides protection to the second outer shell 594. The first section cover 504 and the second section cover 564 can provide protection for the first outer shell 592 and the second outer shell 594, respectively, to reduce the likelihood of tampering with the first outer shell 592 and/or the second outer shell 594.

Referring to FIGS. 1 and 8, in the on store shelf package 10, the package component 500, 900 may be positioned such that the first section cover 502 or the second section cover 564 are positioned adjacent the window 30. The positioning of the first section cover 502 or the second section cover 564 adjacent the window can allow the consumer to visually perceive the personal hygiene device or a component thereof. For those embodiments, where the package 10 comprises a first window, e.g. 30, and a second window opposite the first window, the first section cover 504 and the second section cover 564 may be positioned adjacen the first window and the second window respectively. This can allow the consumer to view the personal hygiene device or component thereof from multiples sides, e.g. front and back. Embodiments are contemplated where the eccentric wall 580 is positioned adjacen the window 30. This orientation may allow the consumer to view a left or right side of the personal hygiene device. In such embodiments, a window opposite the window 30 may not be appropritate since a seam 399 would be exposed in the opposite window.

As discussed previously, the first section cover 504 and the second section cover 564 may comprise detents which facilitate the couping to the first section 502 and the second section 560 respectively. Additionally, the creation of the detents on the first section cover 504 and the second section cover 564 can provide structural support for the first section cover 504 and the second section cover 564. The detents 504A, 504B, 564A, and 564B, may be configured similarly to the detents described heretofore, e.g. 204A, 204B.

The invention claimed is:

1. A package component for holding a personal care device, the package comprising:

a first section having a front face and a back face and a first recess portion therein;

a first section cover disposed adjacent to the first section and being formed integrally with the first section, the first section cover having a front face and a back face;

a first fold line disposed between the first section and the first section cover allowing the front face of the first section cover to engage the back face of the first section;

a second section having a front face and a back face and a second recess portion therein;

a second section cover disposed adjacent to the second section and being formed integrally with the second section, the second section cover having a front face and a back face;

a second fold line disposed between the second section and the second section cover allowing the front face of the second section cover to engage the back face of the second section;

an eccentric cover configured to allow the first section and the first section cover to be folded with respect to the second section and the second section cover, the eccentric cover being disposed between the first section and the second section or between the first section cover and the second section cover.

2. The package component of claim 1, wherein the first section, the first section cover, the second section, the second section cover, are integrally formed.

3. The package component of claim 1, wherien the first section, the first section cover, the second section, the second section cover, and the eccentric cover are integrally formed.

4. The package component of claim 1, wherein the first section cover comprises a detent which engages an interior surface of the first section.

5. The package component of claim 4, wherein the first section cover comprises a plurality of detents.

6. The package component of claim 1, wherein the second section cover comprises a deent which engages an interior surface of the second section.

7. The package component of claim 6, wherein the second section cover comprises a plurality of detents.

8. The package component of claim 1, wherein the first section and the second section.

9. The package component of claim 1, wherein the first section and/or the second section comprise a resealable closing mechanism.

10. The package component of claim 1, wherein the first fold line is generally parallel to a longitudinal axis of the first recess portion.

11. The package component of claim 1, wherein the first fold line is generally perpendicular to a longitudinal axis of the first recess portion.

* * * * *